United States Patent [19]

Ladrigan

[11] 4,027,960

[45] June 7, 1977

[54] TRANSFER SYSTEM FOR ELECTROSTATIC REPRODUCTION MACHINE

[75] Inventor: J. William Ladrigan, Rochester, N.Y.

[73] Assignee: Xerox Corporation, Stamford, Conn.

[22] Filed: Aug. 6, 1975

[21] Appl. No.: 602,497

[52] U.S. Cl. ..... 355/3 R; 355/14; 271/DIG. 2

[51] Int. Cl.[2] ..... G03G 15/00

[58] Field of Search ..... 355/3 TR, 3 R, 14, 3 CH; 271/DIG. 2

[56] References Cited

UNITED STATES PATENTS

| | | | |
|---|---|---|---|
| 3,244,083 | 4/1966 | Gundlach | 355/3 TR |
| 3,267,840 | 8/1966 | Honma et al. | 355/3 TR X |
| 3,575,502 | 4/1971 | Eppe | 355/3 R |
| 3,620,615 | 11/1971 | Volkers | 355/3 R |
| 3,647,292 | 3/1972 | Weikel, Jr. | 355/3 TR |
| 3,970,381 | 7/1976 | Meagher et al. | 355/3 R |

*Primary Examiner*—George H. Miller, Jr.
*Attorney, Agent, or Firm*—Earl T. Reichert

[57] ABSTRACT

An improved transfer system for transferring a developed electrostatic image from a photoreceptor to a transfer member includes an electrically biased transfer roll, and a transfer corona generating device. Preferably, the corona generating device is an ultra-high field device.

The transfer member is first fed between the photoreceptor and the transfer roll whereby transfer is initiated and the transfer member is electrostatically tacked to the photoreceptor, and then the transfer member moves beneath the transfer corona generating device whereby transfer is completed. The transfer roll applies a first charge to the transfer member, and the transfer corona generating device then applies a second but higher charge to the transfer member.

6 Claims, 2 Drawing Figures

TRANSFER SYSTEM FOR ELECTROSTATIC REPRODUCTION MACHINE

BACKGROUND OF THE INVENTION

The present invention relates to an improved transfer system for transferring a developed electrostatic image from a xerographic plate to a transfer member such as a sheet of paper. More particularly, the invention is directed to a transfer system including an electrically biased transfer roll and a transfer corona generating device.

In conventional xerography, a xerographic plate comprising a layer of photosensitive insulating material affixed to a conductive backing is used to support electrostatic latent images. In the xerographic process, the photosensitive surface is electrostatically charged, and the charged surface is then exposed to a light pattern of the image being reproduced to thereby discharge the surface in the areas where light strikes the surface. The undischarged areas of the surface thus form an electrostatic charge pattern (an electrostatic latent image) conforming to the original pattern. The latent image is then developed by contacting it with a finely divided electrostatically attractable powder referred to as "toner." Toner is held on the image areas by the electrostatic charge on the surface. Where the charge is greater, a greater amount of toner is deposited. Thus, a toner image is produced in conformity with a light image of the copy being reproduced. Generally, the developed image is then transferred to a suitable transfer member (e.g., paper), and the image is affixed thereto to form a permanent record of the original document.

In the practice of xerography, the transfer member is caused to move in synchronized contact with the photosensitive surface during the transfer operation, and an electrical potential opposite from the polarity of the toner is applied to the side of the paper remote from the photosensitive surface to electrostatically attract the toner image from the surface to the paper.

A modern high speed duplicating machine sometimes utilizes an electrically biased transfer roll to effect the image transfer. Although a biased transfer roll system effects very good to excellent copy quality, certain copy quality defects are still produced. These copy quality deficiencies may be classified into two general catagories, poor transfer of images (hollow characters and blotchy solids), and the redistribution of toner in and around images (toner disturbances, Lichtenburg figures, and blur). These deficiencies are present to some extend in other prior art transfer systems.

SUMMARY OF THE INVENTION

The present invention is primarily directed to an improved transfer system for overcoming the above mentioned problems. The transfer system includes an electrically biased transfer roll in combination with a transfer corona generating device, preferably an ultra-high field device. A sheet of paper or other transfer member is fed between the transfer roll and the photosensitive surface whereby transfer is partially effected, and the sheet is electrostatically tacked to the photosensitive surface. Transfer of the developed electrostatic image to the sheet is completed as the latter passes under the transfer corona generating device. In passing under the transfer corona generating device, however, the lead edge of the sheet preferably is not charged; only the body and trail edge of the sheet are charged.

After the transfer operation, the sheet passes under a detack corona generating device in order to lessen the electrostatic attraction between the photosensitive surface and the sheet so that the latter can be removed and transported to a fusing device. When passing under the detack corona generating device, the body and trail edge of the sheet preferably receive a charge which is of a smaller magnitude than the charge deposited on the lead edge of the sheet in order to prevent the developed image from being retransferred from the sheet to the photosensitive surface.

DESCRIPTION OF THE INVENTION

Figure 1:
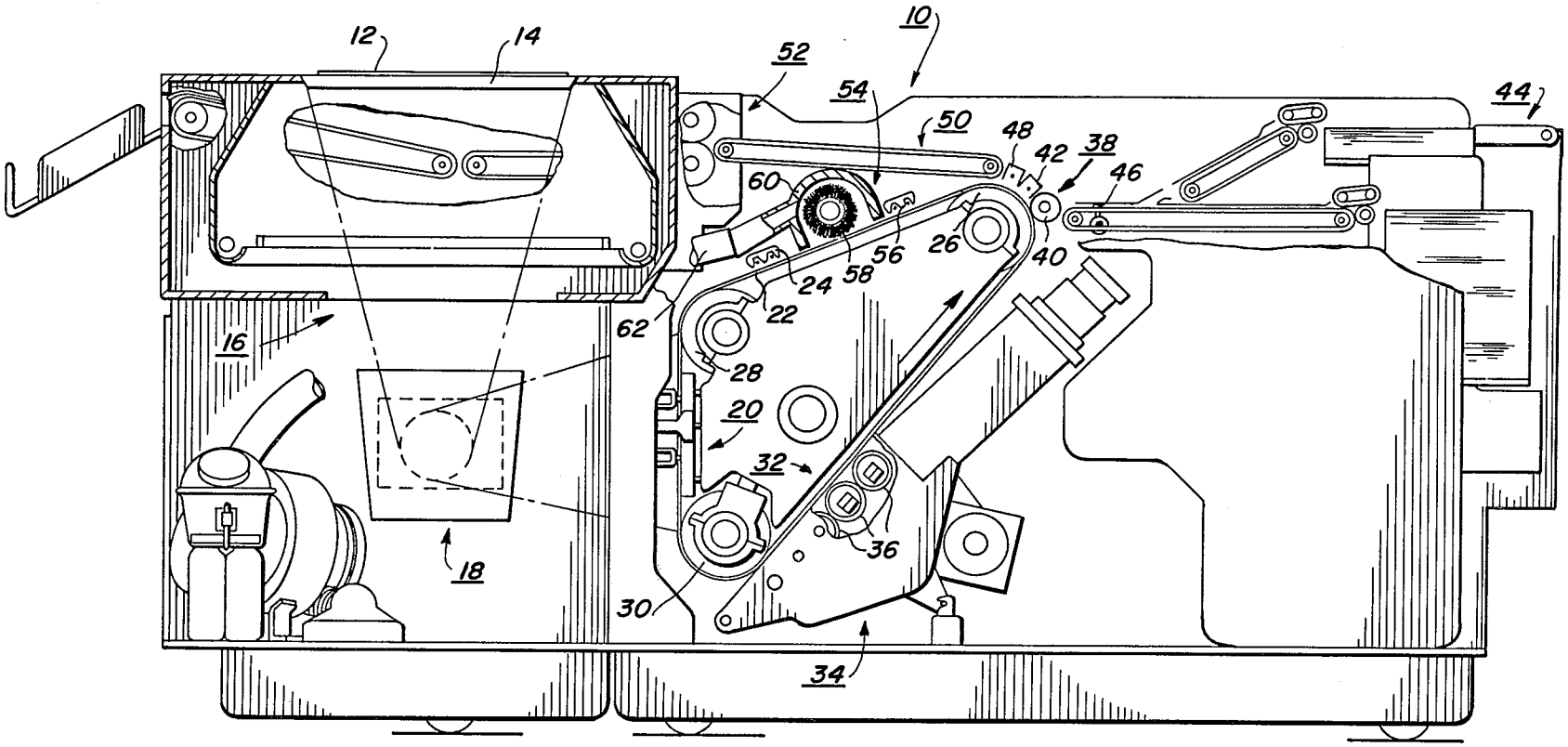
FIG. 1 is a schematic sectional view of an electrostatic reproduction machine embodying the principles of the present invention.

For a general understanding of an electrostatic reproduction machine in which the present invention may be incorporated, reference is made to FIG. 1. As in all electrostatic reproduction machines of the type illustrated, a light image of an original is projected onto the photosensitive surface of a xerographic plate to form an electrostatic latent image thereon. Thereafter, the latent image is developed with an oppositely charged developing material comprising carrier beads and toner particles triboelectrically adhering thereto to form a xerographic powder image corresponding to the latent image on the photosensitive surface. The powder image is then electrostatically transferred to a transfer member such as a sheet of paper to which it may be fixed by a fusing device whereby the toner image is caused permanently to adhere to the transfer member.

In the illustrated machine 10, an original 12 to be copied is placed upon a transparent support platen 14 fixedly arranged in an illumination assembly indicated generally by the reference numeral 16. While upon the platen, the illumination assembly flashes light rays upon the original, thereby producing image rays corresponding to the informational areas on the original. The image rays are projected by means of an optical system 18 to an exposure station 20 for exposing the surface of a moving xerographic plate in the form of a flexible photoconductive belt or photoreceptor 22. In moving in the direction indicated by the arrow, prior to reaching the exposure station 20, that portion of the belt being exposed would have been uniformly charged to approximately +900 volts by a corona generating device 24 located at a belt run extending between the belt supporting rollers 26 and 28. The exposure station extends between the roller 28 and a third roller 30.

The exposure of the photosensitive surface of the belt to the light image discharges the surface in the areas struck by light whereby an electrostatic latent image remains on the belt in image configuration corresponding to the light image projected from the original on the support platen. As the belt continues its movement, the latent image passes around the roller 30 and through a developing station 32 where a developing apparatus indicated generally by the reference numeral 34 is positioned. The developing apparatus 34 comprises a plurality of magnetic brushes 36 which carry developing material to the surface of the upwardly moving belt 22. As the developing material is applied to the belt, toner particles in the development material are electrostatically attracted to the charged photosensitive surface to form a powder image (an electrostatic developed image).

The developed electrostatic image is transported by the belt 22 to a transfer station 38 where a sheet of paper is moved at a speed in synchronism with the moving belt in order to effect transfer of the developed image. Located at the transfer station 38 is a transfer roll 40 which is arranged on the frame of the machine to contact the back side of the sheet of paper as the latter is moved or fed between the belt and the transfer roll. The roll 40 is electrically biased with sufficient voltage so that the developed image on the belt may be electrostatically attracted to the adjacent side of a sheet of paper as the latter is brought into contact therewith. The transfer is initiated by the transfer roll 40, but is completed by the ultra-high field corona generating device 42. The corona generating device 42 applies a higher charge to the sheet than does the transfer roll, the former producing a field of approximately 40 to 60 volts per micron, the latter producing a field of approximately 27 to 32 volts per micron. The transfer roll 40 applies a charge to the entire sheet as it moves between the roll and the belt 22. As will be explained below, however, the transfer corona generating device 42 does not apply charge to the lead edge of the sheet, but only to the remainder thereof.

A suitable sheet transport mechanism transports sheets of paper seriatim from a paper handling mechanism indicated generally by the reference numeral 44 to the developed image on the belt as the same is carried around the roller 26. In passing from the paper handling mechanism to the transfer roll 40, each sheet contacts a plurality of registraton fingers 46, the operation of which will be more fully described below.

As a sheet emerges from the transfer station 38, a charge is deposited thereon by a detack corona generating device 48 to lessen the electrostatic attraction between the belt 22 and the sheet so that the latter can be removed by a vacuum stripping and transport mechanism 50, the device 48 having a plastic shield. The sheet is thereafter retained on the underside of the vacuum stripping transport mechanism 50 for movement into a fuser assembly indicated generally by the reference numeral 52 wherein the powder image on the sheet is permanently affixed thereto. After fusing, the finished copy is discharged at a suitable point for collection. The toner particles remaining as residue on the belt 22 are carried by the belt to a cleaning apparatus 54. The cleaning apparatus 54 comprises a corona discharge device 56 for neutralizing charges remaining on the untransferred toner particles, a rotating brush 58 mounted within a housing 60, and a vacuum outlet 62.

Figure 2:
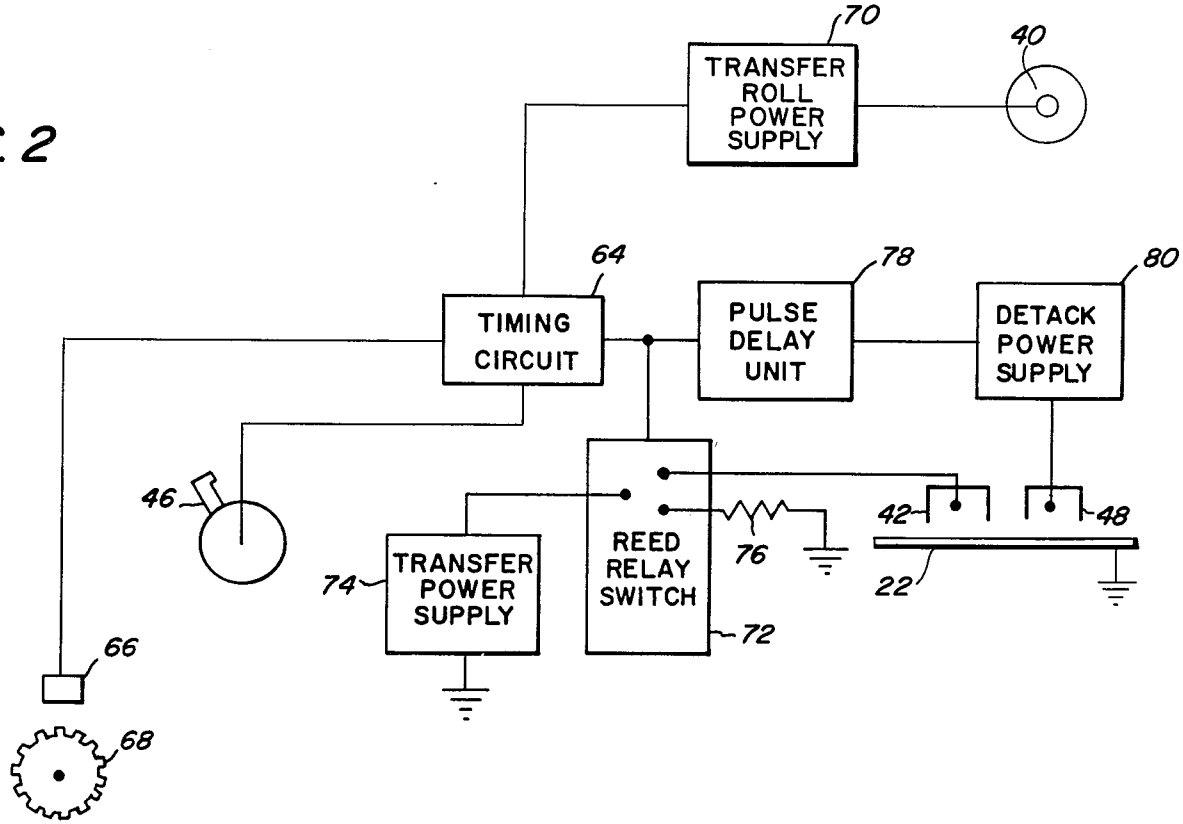
FIG. 2 is a schematic diagram of the circuit for controlling both the transfer and the detack corona generating devices.

Referring to FIG. 2, the operation of the present invention will now be described in more detail. The movement of each sheet fed to the transfer station 38 is synchronized so that the sheet contacts the rotating registration fingers 46. As the registration fingers 46 rotate out of the path of the sheet, a reset pulse is sent to the timing circuit 64 to reset the latter to zero. The timing circuit now begins to count the clock pulses generated by the detector 66, the latter counting the teeth on the main drive gear 68 of the machine 10. Since both the number of teeth on the gear 68 and the rotation speed of the gear are known, and since all the subsystems of the machine 10 are synchronized with the main drive gear, the location of a sheet at any particular time after registration can be accurately determined.

When the sheet is at the proper location with respect to the transfer roll 40, an output pulse is delivered from the timing circuit to a suitable constant current power supply 70 to actuate the latter so that the transfer roll 40 applies a first charge to the entire sheet. When the sheet reaches the proper location with respect to the transfer corona generating device 42, an output pulse is delivered from the timing circuit to the reed relay switch 72 to switch a suitable constant current power supply 74 from the dummy load 76 to the transfer corona generating device 42. As stated above, the transfer corona generating device 42 preferably applies a second charge to all but the lead edge of the sheet, the second charge being of a greater magnitude than the first charge applied by the transfer roll 40. By not applying a charge to the lead edge of the sheet with the corona generating device 42, the sheet is easier to detack. The same output pulse used to switch the reed relay switch 72 is also delivered to the pulse delay unit 78 where it is delayed for a predetermined time before being delivered to the power supply 80. In this manner, the transfer roll 40, and the corona generating devices 42 and 48 are actuated at the proper times so that the appropriate charges are deposited on the sheets passing thereunder. Preferably, the detack corona generating device is actuated so as to apply a larger detacking charge to the lead edge of a sheet than to the remainder of the sheet as described in U.S. Pat. No. 3,970,381. If desired, however, the same detacking charge may be applied to the entire sheet.

The ultra-high transfer corona generating device augments the transfer roll, the latter now serving to apply a charge to the entire sheet to initiate transfer as well as to tack the sheet to the photosensitive surface of the belt. Since each sheet is not rolled into contact with and electrostatically tacked to the photosensitive surface of the belt by the transfer roll, the ultra-high field transfer corona generating device very effectively completes the transfer operation to produce a very stable unfused image on the sheet, an image much more stable than can be produced with a prior art transfer system utilizing a transfer roll only.

If enough of a charge is placed on a sheet of paper, then an electric field large enough for air breakdown is generated. Air breakdown takes place (according to Paschen's Law) in the region with the largest paper to photoreceptor gap. Because each sheet of paper has been rolled into contact with and electrostatically tacked to the photosensitive surface of the belt before the application of the ultra-high field, selective air breakdown occurs, i.e., the breakdown occurs in the background regions adjacent to toner images; thus, each sheet is in contact with the developed image and this tends to prevent breakdown in image areas and confines the breakdown to background areas. This results in a negative charge on the image side of the sheet of paper which tends to reduce the electrostatic toner repulsion forces. As a result, a very stable unfused image is produced on each sheet, and little or no redistribution of toner in and around images occurs. In addition, the image produced by the present transfer system is less sensitive to paper resistivity. Thus, a wider selection of copy paper is available for use with the present transfer system. In addition to stabilizing the unfused image on each sheet of paper, the air breakdown that occurs tends to decrease the net charge on the background toner, thus resulting in reduced background transfer.

In addition, in utilizing the present transfer system as compared to one utilizing a transfer roll only, the requirements relating to temperature, humidity, and transfer roll material can be relaxed somewhat because the present system is not as dependent on the transfer roll.

Also, tests have indicated that the present transfer system reduces photoreceptor filming as compared to a transfer system utilizing a transfer roll only; filming life can be extended by at least a factor of three. Although the filming process is a very complicated interaction between various machine subsystems, the most important interaction is believed to be that between fine toner particles (less than 4 microns) and the cleaning brush. The present transfer system transfers significantly more of the fine toner particles, thus, decreasing the number of fine toner particles on the cleaning brush; consequently, the photoreceptor filming rate is substantially reduced. Also, because increased brush speed or increased brush interference with the photoreceptor increases the filming rate, it may be possible to decrease both the speed and the interference by utilizing the present invention.

While the invention has been described with reference to the structure disclosed, it is not confined to the details set forth, but is intended to cover such modifications or changes as may come within the scope of the following claims.

What is claimed is:

1. An improved transfer system for transferring a developed electrostatic image from a charged photoreceptor to a transfer member, the improvement comprising first means for pressing the transfer member into contact with the developed image while simultaneously applying a first charge to the transfer member of the same polarity as the charge on the photoreceptor and of a magnitude sufficient to both initiate transfer of the developed electrostatic image and electrostatically tack the transfer member to the photoreceptor, and second means for applying a second charge to the transfer member while the latter is electrostatically tacked to the photoreceptor, the second charge being of the same polarity as but of a greater magnitude than the first charge, whereby transfer of the developed electrostatic image is completed.

2. An improved transfer system according to claim 1, wherein the transfer member has a lead edge, and further including means for preventing the second charge from being applied to the lead edge of the transfer member.

3. An improved transfer system according to claim 2, in combination with means for applying a third charge to the transfer member subsequent to applying the second charge, the third charge being of a magnitude and polarity sufficient to lessen the electrostatic attraction between the photoreceptor and transfer member.

4. An improved transfer system according to claim 2, in combination with means for applying both a third charge to the lead edge of the transfer member and a fourth charge to the remainder of the transfer member subsequent to the application of the second charge.

5. An improved process for transferring a developed electrostatic image from a charged photoreceptor to a transfer member, the improvement comprising:

a. pressing the transfer member into contact with the developed image while simultaneously applying a first charge to the transfer member of the same polarity as the charge on the photoreceptor, the first charge being sufficient to both initiate transfer of the developed electrostatic image and to electrostatially tack the transfer member to the photoreceptor; and then b. applying a second charge to the transfer member while the transfer member is electrostatically tacked to the photoreceptor, the second charge being of the same polarity as but of a greater magnitude than the first charge, whereby transfer of the developed electrostatic image is completed.

6. An improved process for transferring a developed electrostatic image from a charged photoreceptor to a transfer member in contact with the developed image, the improvement comprising:

a. applying a first charge to the transfer member of the same polarity as the charge on the photoreceptor, the first charge being sufficient to both initiate transfer of the developed electrostatic image and electrostatically tack the transfer member to the photoreceptor and then b. applying a second charge to the transfer member while the transfer member is electrostatically tacked to the photoreceptor, the second charge being of the same polarity as but of a greater magnitude than the first charge, whereby transfer of the developed electrostatic image is completed.

* * * * *